US006126561A

United States Patent [19]

Mark

[11] Patent Number: 6,126,561

[45] Date of Patent: Oct. 3, 2000

[54] PUCK FOR INDOOR HOCKEY

[76] Inventor: Eberhard von der Mark, Oberhombrechen 10, 42499 Hückesdwagen, Germany

[21] Appl. No.: 09/142,837

[22] PCT Filed: Mar. 5, 1997

[86] PCT No.: PCT/EP97/01104

§ 371 Date: May 3, 1999

§ 102(e) Date: May 3, 1999

[87] PCT Pub. No.: WO97/33662

PCT Pub. Date: Sep. 18, 1997

[30] Foreign Application Priority Data

Jan. 29, 1996 [DE] Germany ..... 296 04 456 U

[51] Int. Cl.[7] ..... A63B 67/14

[52] U.S. Cl. ..... 473/588

[58] Field of Search ..... 473/588, 589, 473/570; 273/DIG. 24

[56] References Cited

U.S. PATENT DOCUMENTS

| | | | |
|---|---|---|---|
| 3,102,727 | 9/1963 | Rice | 473/570 |
| 4,183,536 | 1/1980 | Platt | 473/570 |
| 4,846,475 | 7/1989 | Newcomb et al. | 473/570 |
| 4,968,036 | 11/1990 | Von Der Mark | 473/570 |
| 5,149,096 | 9/1992 | Keating et al. | 473/588 |
| 5,269,520 | 12/1993 | Vellines . | |
| 5,346,214 | 9/1994 | Bruhm . | |
| 5,366,219 | 11/1994 | Salcer et al. | 473/588 |

FOREIGN PATENT DOCUMENTS

| | | |
|---|---|---|
| 196 04 456 U 1 | 3/1996 | Germany . |
| WO 88/00075 | 1/1988 | WIPO . |

*Primary Examiner*—Raleigh W. Chiu

*Attorney, Agent, or Firm*—Hutchins, Wheeler & Dittmar, PC

[57] ABSTRACT

The invention relates to a hockey puck with a flat cylindrical body (1) of flexible elastic material. The aim of the invention is to provide a puck which is particularly suitable for playing hockey on hall floors or in the street and is as visible as possible during the game. This aim is attained in that the flat cylindrical body (1) consits of several disc-shaped segments (2, 3, 4) firmly bonded together, where a central segment (3) is made of a transparent material and has a recess for an insert with a light source (5, 6), a power source (7), a switch (8) and regulating and control components.

24 Claims, 3 Drawing Sheets

PUCK FOR INDOOR HOCKEY

FIELD OF THE INVENTION

The invention relates to a hockey puck with a flat cylindrical body made of rubber-elastic material.

BACKGROUND OF THE INVENTION

Pucks of this kind are conventionally used in ice hockey games. The rubber-elastic material gives known pucks an optimum weight that ensures good handling during play. Because of the elastic properties, the boards of the playing field can advantageously be incorporated into play. The sliding resistance of the rubber-elastic material on ice is sufficiently low to permit fast, long shots with the puck sliding on ice. The flexibility of the rubber-elastic material ensures that the risk of injury to the players from the puck is limited.

Ice hockey pucks must essentially be made of a homogeneous body since because of the kinetic energy of an impact when playing off the boards, there is a serious danger of individual attached parts of the puck breaking off.

Pucks are also known to the inventor in which rotatable balls are inserted, said balls projecting down from the faces of the disk-shaped body. These elements are intended to permit advantageous movement properties of the puck on surfaces other than ice, for example on sport hall floors made of wood or linoleum or on asphalt. A rubber puck would not slide on such stick because of the adhesive friction between the rubber and the surface. The spherical rollers are intended to allow the puck to roll easily along the surface of the ground. However, even a small amount of contamination in the bearings of the spherical rollers could impede their rotational freedom and interfere with the movement properties of the puck. There is also the serious danger that the rollers, mounted rotatably in the puck, could come loose during play because of the high forces acting on the puck, and be catapulted uncontrollably at high speed out of the rubber-elastic body of the puck. This poses a serious risk of injury to the players.

U.S. Pat. No. 5,366,219 teaches a puck for indoor or street hockey, with whose body sliding elements made of a hard and low-friction material are permanently connected, said elements projecting out of the rubber-elastic material on one sliding surface of the puck. The sliding elements are assembled to form a structure in the form of a ring, with the rubber-elastic material injected around them. The insertion of the circular structure into an injection mold and the subsequent injection constitute a very expensive and cost-intensive manufacturing process.

Finally, ice hockey pucks are known from EP Patent 0 273 944 which have a recess in the middle for a light source and an energy source, with light channels filled with highly transparent plastic extending from this recess to the circumferential or marginal surface of the puck. These pucks offer the additional advantage during play that they are very much easier to see because of their illumination.

It is desirable to improve on a puck of the type recited at the outset in such fashion that it is suitable for playing hockey on surfaces other than ice, especially for indoor or street hockey, it does not have the disadvantages described above, and it offers other advantages during play.

SUMMARY OF THE INVENTION

According to the present invention the flat, cylindrical body is composed of a plurality of disk-shaped segments permanently connected together, with the middle segment being made of a transparent material and having a recess for an insert with a light source, an energy source, a switch, and regulating and control parts.

The disk-shaped stricture, which would have led to certain destruction of the puck in ice hockey pucks because of the high forces involved when playing off the boards turns out to be especially advantageous in a puck for indoor or street hockey. In indoor or street hockey, the speeds with which a puck strikes any boards that may be present are very much lower than in ice hockey, so that in this case there is no need to fear that the puck will be destroyed as a result of the failure of the connection between the disk-shaped segments. The middle section consists of a transparent material and offers a suitable recess for insertion of a light source, energy source, switch, and regulating and control parts. Additional light channels are not necessary, since the light beams can be conducted through the middle segment to the entire central circumferential surface of the puck.

Advantageously, the switch is so designed that the switch is actuated as a result of vibrations of the puck to allow energy to flow to the light source, and the regulating and control parts are so designed that in a few seconds, for example 10 to 30 seconds after actuation of the switch, the energy supply to the light source is interrupted. Such a switch can be formed by a piezo switch which is designed to be very sensitive to contact. Above this piezo switch is a hollow chamber into which a small light-weight actuating element, a plastic ball 2 mm in diameter for example, is inserted. During the rapid movement of the puck, the actuating element strikes the piezo switch and causes the energy supply to be switched on. If the puck remains at rest for several seconds, the energy supply to the light source is cut off. Thus, the puck according to the invention lights up only during play and energy consumption during pauses in play is avoided.

Advantageously, as in the puck from U.S. Pat. No. 5,366,219, sliding elements made of a hard, low-friction material are provided that project from the rubber-elastic material on one sliding surface of the puck. Since in this case the puck consists of segments fitted together, the sliding elements can simply be inserted into the segments prior to assembly. The costly method of injection with rubber-elastic material is thus eliminated.

The sliding elements preferably consist of PTFE, a very low-friction plastic, known for example by the trade name Teflon®. Sliding elements made of metal, steel for example, can be advantageous for playing on asphalt (street hockey).

In contrast to the rollers described earlier, the sliding elements reduce the friction of the puck on the surface because of their low friction properties, without any special rotating or rolling bearings. Since the sliding elements are connected permanently, i.e. nonrotatably with the rubber-elastic material of the cylindrical body, the connection can be made much more durable than in the case of spherical bodies. A connection that is absolutely protected against the sliding elements being catapulted out of the body of the puck can be achieved by the sliding elements having the shape of a pin whose point projects from the rubber-elastic material on one face of the puck and which has a retaining plate abutting the rubber-elastic material at the end opposite the point. This pin can either be potted with rubber-elastic material or, in the multilayer puck described below, can be pushed through a recess in the rubber-elastic material. The large-area retaining plate securely abuts the rubber material in the marginal area of the recess so that the sliding element is held securely.

Preferably, the face is made spherical around the point of the sliding element. The point projects only slightly from the dome-shaped rubber material in its vicinity, so that there is no risk of injury. The point projects sufficiently far out of the face through the dome-shaped elevation in its vicinity to prevent contact between this face of the rubber-elastic body and the surface during play.

The pin point should project at least 1 mm and preferably 2 to 4 mm from the rubber-elastic material to ensure a good sliding property. By rounding off the portions of the sliding elements that project out of the rubber-elastic material, the sharp edges of the sliding elements are prevented from catching on irregularities in the surface, interfering with the sliding of the puck. The risk of injury by the hard sliding element is also reduced.

A plurality of pins can be provided on one retaining plate, said pins either running parallel to one another and projecting from the same face of the puck, or arranged coaxially and projecting from opposite faces. In the second case, the retaining plate is located at the middle of a rod-shaped element, which forms a pin on either side of the retaining plate.

The annular edges of the upper and lower faces of the cylindrical body of the puck can be beveled or rounded. This allows the players to grip below the edge with their sticks and to lift the puck during play in order to make a high shot, at knee level for example.

A serious problem in playing with a puck that has sliding elements on its faces consists in the fact that the annular edges of the puck are also made of rubber-elastic material and can come in contact with the surface during play. The rubber material of the edges immediately brakes the sliding movement of the puck and as a rule results in an uncontrollable overturning of the puck on the playing field. To avoid this disadvantage, annular sliding elements can be placed along the two edges of the puck. The combination of these annular sliding elements and the sliding elements on the faces of the puck means that all the important sliding surfaces of the puck have a low frictional value and the puck slides controllably when its edge contacts the surface. The single possible contact surface of the puck with the playing surface, which in this case does not consist of low-friction material, is the circumferential surface that is in the shape of a cylindrical jacket. When this surface comes in contact with the playing surface, the puck basically rolls away, so that it is not necessary to reduce the friction. Because of the flat disk-shaped design of the puck, the puck does not as a rule remain on its circumferential edge but falls onto one of the two faces.

It is also possible to design the annular sliding elements on the edges of the puck in such fashion that they project beyond both the faces and the circumferential surface of the puck. In this case the puck basically contacts the playing surface only with its sliding elements on the annular edges of the disk-shaped body.

The annular sliding element can have a retaining bead surrounded by the rubber-elastic material. When the puck is manufactured, the rubber-elastic material can be injected around the retaining bead of the sliding element that is placed in the injection mold for the puck. Alternatively, the rubber-elastic body of the puck can be provided with a receiving groove into which the retaining bead of the sliding element is pressed.

Other features and advantages of the invention follow from the description of the drawing.

DESCRIPTION OF THE PREFERRED EMBODIMENT

Figure 1:
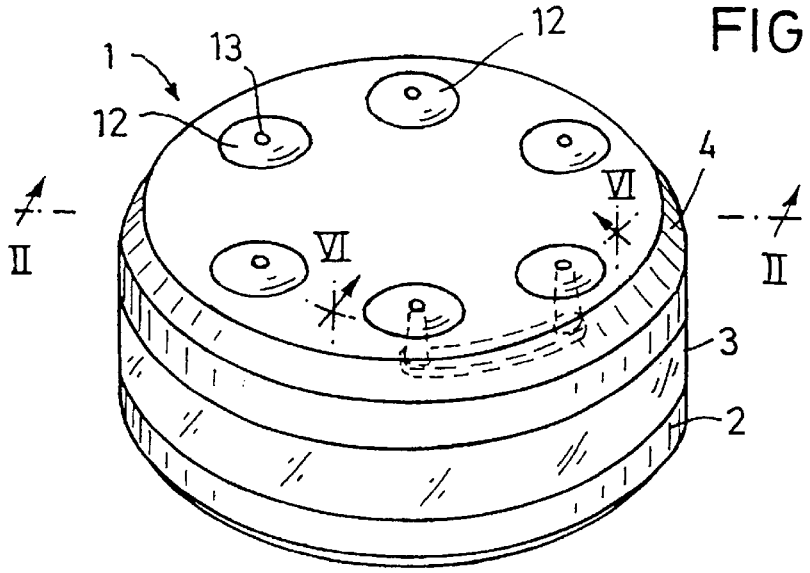
FIG. 1 is a view of one embodiment of a puck according to the invention.
Figure 2:
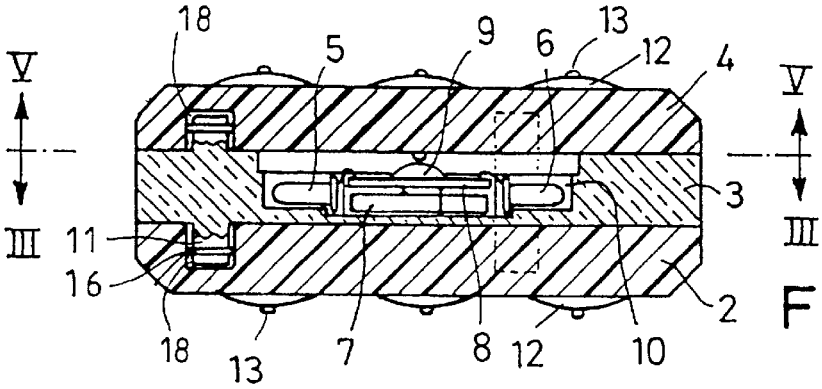
FIG. 2 is a view of the puck in FIG. 1 sectioned along line II—II.

The puck shown in FIG. 1 has a flat, cylindrical, i.e. disk-shaped body 1 composed of three segments 2, 3, 4. The lower segment 2 and the upper segment 4 are made of rubber-elastic material. The middle segment 3 consists of a glass-clear thermoplastic. Both the lower segment 2 and the upper segment 4 have six dome-shaped sliding nubs 12 arranged at regular angular intervals, from the center of which nubs points 13 of the pin-shaped sliding elements 14 project. As can be seen in FIG. 2, pin point 13 projects approximately 1 mm out of the rubber-elastic material of sliding nub 12. If there is a danger that pin point 13 will be worn away severely during play, it can also project further, 2 to 4 mm for example, out of sliding nub 12.

Figure 3:
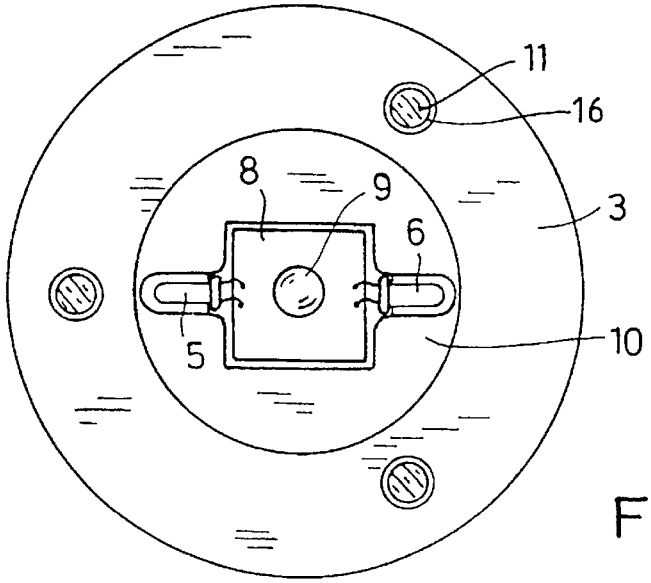
FIG. 3 is a view of the puck in FIG. 2 sectioned along line III—III.

As can be seen in FIGS. 2 and 3, the transparent intermediate segment 2 is provided with three retaining pins 11 that engage recesses 18 in the two outer segments 2, 4. For a reliable connection, the retaining pin 11 is provided with an annular bead 16. A stronger connection can be achieved by using swallowtail-shaped retaining elements on middle segment 3, which are arranged in a ring on the top and bottom surfaces of middle segment 3 and engage matching undercut grooves in outer rubber-elastic segments 2, 4. Retaining elements of this kind are not shown in the drawings.

As can be seen from FIG. 3, central glass-clear segment 3 has a receptacle for an electrical circuit on a supporting plate 9 which comprises two LEDs 5, 6 as a light source and a battery 7 and a switch 8. Switch 8 is a so-called piezo switch that reacts to pressure and allows the current to flow from battery 7 to light sources 6. In addition, regulating and control elements (not shown) are provided in the circuit which excite LEDs 5, 6 to flash. In addition, the regulating and control elements ensure that the supply of current to LEDs 5 and 6 is shut off after a certain time, 10 to 30 seconds for example. To actuate switch 9, a projection is provided in upper segment 4 of the puck that presses on switch 9. To actuate the switch, a deformation of the upper segment and hence a relatively high force are required. Alternatively, a cavity can be formed in the rubber-elastic material of upper segment 4 above switch 9, in which an actuating element, a plastic ball for example, is located (not shown in the drawing). In this case, relatively mild vibrations cause switch 9 to be actuated.

Figure 4:
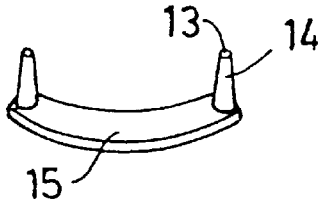
FIG. 4 is a retaining plate with two pin-shaped sliding elements.
Figure 5:
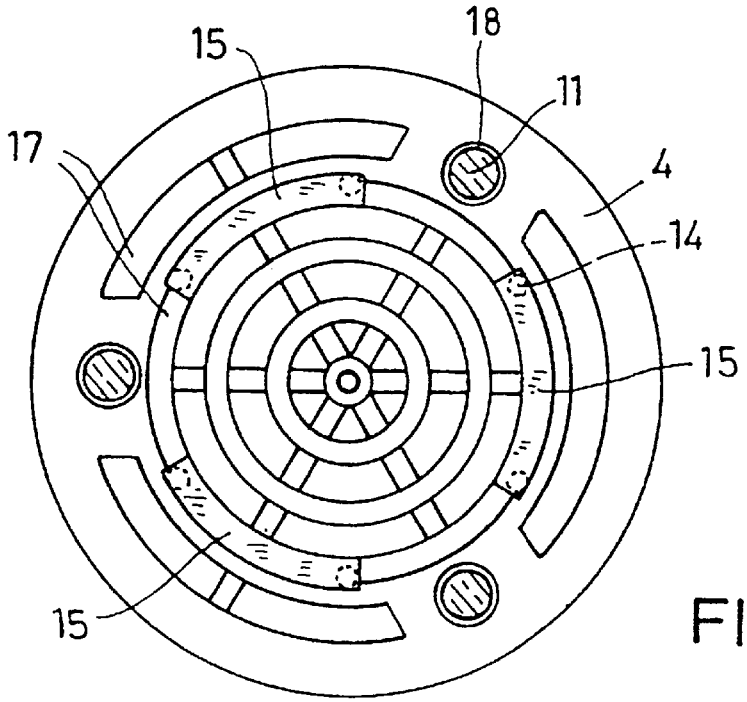
FIG. 5 is a view of the puck sectioned along line V—V in FIG. 2.
Figure 6:
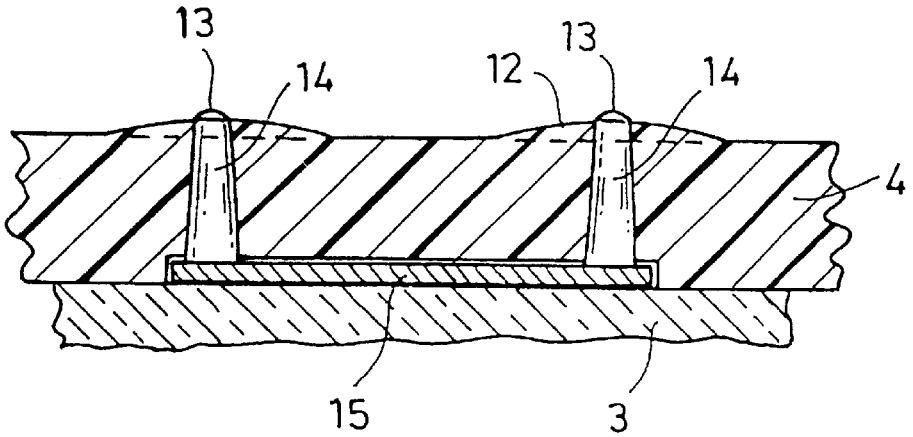
FIG. 6 is a partial view of the puck sectioned along line VI—VI in FIG. 1.

The assembly of the puck according to the invention can be seen in FIGS. 4 to 6. The outer segments 2 and 4 of the puck have annular recesses 17 on their interiors. The second annular recess 17, as viewed from the circumferential surface of the puck, is provided with holes to receive sliding pins 14, which terminate at the face of puck body 1 in the vicinity of dome-shaped sliding nubs 12. Three parts according to FIG. 4 are inserted into each outer segment 2, 4 of the puck, said parts having two sliding pins 14 that project through the bores and are connected integrally with a retaining plate 15 in the shape of a ring segment.

Figure 7:
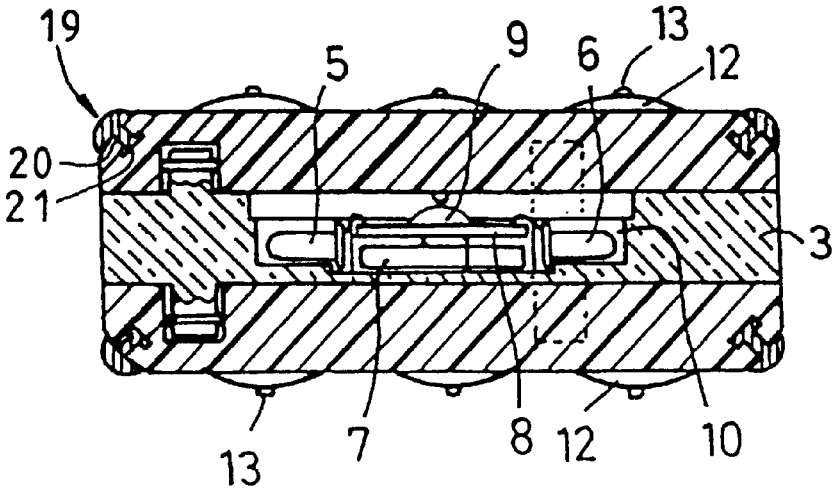
FIG. 7 is a view of a puck with annular sliding elements, corresponding to FIG. 2.

The puck shown in FIG. 7 also has sliding rings 19 in the shape of circular rings as sliding elements, which together form the annular edges of cylindrical body 1 of the puck. Each sliding ring 19 is connected by a rib 20 with a bead 21 that engages a matching recess in rubber-elastic segments 2, 4. Bead 21 in the present case has an essentially rectangular cross section and must be potted with the rubber-elastic material of segments 2, 4.

What is claimed is:

1. A puck with a flat cylindrical body made of rubber-elastic material, wherein the flat, cylindrical body includes a plurality of disk-shaped segments permanently connected with each other, with a middle segment having transparent material and a recess for an insert with a light source, an energy source, a switch, and regulating and control parts and, wherein the switch is so designed that as a result of the vibrations of the puck, the switch is actuated to allow energy to flow to light source and wherein the regulating and control parts are so designed that the energy supplied to light sources is interrupted after the switch is actuated.

2. A puck according to claim 1, wherein the regulating and control parts are so designed that the energy supplied to light sources is interrupted for a period of time between 10 and 30 seconds after the switch is actuated.

3. A transparent, disk-shaped segment for a hockey puck, comprising a) a surface capable of attaching to at least one other disk-shaped segment to form a hockey puck, and b) an insert having a light source connected to an energy source, a pressure-sensitive switch, and regulating and control parts designed to stop the flow of electricity after a certain time, thereby turning off the light source.

4. A segment according to claim 3, wherein the switch includes a movement-sensitive piezo device.

5. A segment according to claim 4, further comprising a hollow chamber adjacent to the switch.

6. A segment according to claim 5, wherein a small actuating element is disposed in the chamber.

7. A segment according to claim 6, wherein the element closes the switch, to turn on the light source, in response to jostling.

8. A segment according to claim 7 wherein the regulating and control parts can turn off the light source.

9. A hockey puck with a flat, cylindrical body made of rubber-elastic material, wherein the flat, cylindrical body includes a plurality of disk-shaped segments permanently connected with one another, with a middle segment being substantially transparent and having a recess for an insert with a light source, an energy source, a switch, and regulating and control parts.

10. A puck according to claim 9, wherein the segments adjoining one another have matching retaining elements that mesh with one another shapewise.

11. A puck according to claim 9, further comprising sliding elements made of a hard and low-friction materia, the elements being permanently attached to the body and projecting from the rubber-elastic material at one sliding surface of the puck.

12. A puck according to claim 11, wherein the sliding elements comprise a low-friction plastic, including polytetrafluoroethylene (PTFE).

13. A puck according to claim 11, wherein the sliding elements include steel.

14. A puck according to claim 11, wherein a portion of the sliding element that projects from the rubber-elastic material is rounded off.

15. A puck according to claim 11, wherein the flat cylindrical body includes an annular edge and the sliding element has an annular shape and is disposed along the annular edge of the puck.

16. A puck according to claim 9, wherein the flat cylindrical body includes at least one annular edge that is at least one of beveled and rounded.

17. A puck with a flat cylindrical body made of rubber-elastic material, wherein the flat, cylindrical body includes a plurality of disk-shaped segments permanently connected with each other, with a middle segment having transparent material and a recess for an insert with a light source, an energy source, a switch, and regulating and control parts and further comprising sliding elements made of a hard and low-friction material, the elements being permanently attached to the body and projecting from the rubber-elastic material at one sliding surface of the puck, wherein the sliding elements have the shape of pins whose points project from the rubber elastic material at one face of the puck and whose opposite ends have retaining plates that abut the rubber-elastic material.

18. A puck according to claim 17, wherein the face of the puck is designed to be dome-shaped around the point of a sliding element.

19. A puck according to claim 17, wherein the pin point projects 2 to 4 mm from the rubber-elastic material of body.

20. A puck according to claim 17, wherein a plurality of pins is located on one retaining plate.

21. A puck according to claim 20, wherein two pins are located coaxially and opposite one another on a retaining plate, with points each projecting from one face of the puck.

22. A puck with a flat cylindrical body made of rubber-elastic material wherein the flat, cylindrical body includes a plurality of disk-shaped segments permanently connected with each other, with a middle segment having transparent material and a recess for an insert with a light source, an energy source, a switch, and regulating and control parts and further comprising sliding elements made of a hard and low-friction material, the elements being permanently attached to the body and projecting from the rubber-elastic material at one sliding surface of the puck, wherein the flat cylindrical body includes an annular edge and the sliding element has an annular shape and is disposed along the annular edge of the puck, and wherein the annular sliding element includes a rib with a retaining bead, with the retaining bead being surrounded by the rubber-elastic material.

23. A method of lighting a puck, comprising:

a) providing a plurality of connected, cylindrical disks, a middle one of which is transparent throughout, b) forming a recess in the middle disk, c) inserting a light source, energy source, switch and regulating and control parts into the recess, and d) actuating the switch so as to cause the light source to turn on.

24. The method of claim 23, wherein actuating the switch includes applying pressure.

* * * * *

UNITED STATES PATENT AND TRADEMARK OFFICE

CERTIFICATE OF CORRECTION

PATENT NO. : 6,126,561
DATED : October 3, 2000
INVENTOR(S) : Eberhard von der Mark It is certified that error appears in the above-identified patent and that said Letters Patent is hereby corrected as shown below:

Title page, item [76],
In inventor's address, change "Hückesdwagen" to -- Hückeswagen --.

Title page, item [30],
Change priority date of German Application No. 296 04 456 U from "Jan. 29, 1996" to -- March 12, 1996 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*